US005390820A

United States Patent [19]

Wright et al.

[11] Patent Number: 5,390,820

[45] Date of Patent: Feb. 21, 1995

[54] ELEVATING DISPENSING DEVICE FOR FLEXIBLE SHEET MATERIAL

[76] Inventors: Kenneth E. Wright; Shirlene Wright, both of 6785 S. 1544 West, West Jordan, Utah 84084

[21] Appl. No.: 202,261

[22] Filed: Feb. 25, 1994

[51] Int. Cl.[6] ..... B65H 1/08

[52] U.S. Cl. ..... 221/52; 221/56; 221/279; 221/305; 221/120.17; 221/101

[58] Field of Search ..... 221/52-54, 221/56, 58-60, 279, 305; 206/556; 229/101, 120.17, 117.16

[56] References Cited

U.S. PATENT DOCUMENTS

| | | | |
|---|---|---|---|
| 905,882 | 12/1908 | Joachimson | 221/58 |
| 2,027,672 | 1/1936 | Broerer | 221/60 |
| 2,087,181 | 7/1937 | Conway | 312/62 |
| 2,347,823 | 5/1944 | Goodman et al. | 312/62 |
| 2,598,050 | 5/1952 | Guyer | 221/52 |
| 3,202,316 | 8/1965 | Silver | 221/59 |
| 3,826,407 | 7/1974 | Keating | 221/63 |
| 3,942,682 | 3/1976 | McKay | 221/58 |
| 4,185,753 | 1/1980 | Leto | 221/45 |
| 4,616,767 | 10/1986 | Seido | 221/58 |

*Primary Examiner*—H. Grant Skaggs
*Attorney, Agent, or Firm*—J. David Nelson

[57] ABSTRACT

An elevating dispenser for flexible sheet materials and more particularly for interleafed cosmetology end papers. The flexible sheets are contained in a carton with a dispensing aperture in the top wall. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform. This facilitates the removal of sheets from a stack of diminishing thickness as the sheets are removed, one at a time. The elevating platform is retained in progressively upward positions by friction between its edges and the inside surfaces of the carton walls and by tabs in the end walls which are pressed into the chamber of the carton beneath the elevating platform.

21 Claims, 2 Drawing Sheets

ELEVATING DISPENSING DEVICE FOR FLEXIBLE SHEET MATERIAL

FIELD OF THE INVENTION

This invention relates to dispensing devices for flexible sheet material and more particularly to elevating, dispensing devices for end wrap papers used in cosmetology.

BACKGROUND OF THE INVENTION

A cosmetologist customarily utilizes small, thin, rectangular sheets of flexible, absorbent paper or synthetic material, commonly referred to as "end paper", when applying a permanent wave treatment to the hair of a patron. This end paper is used with a curling device to grip the hair in place while it is coiled over the curling device and to maintain permanent wave solution in contact with the hair. The cosmetologist uses the end paper by folding the end paper over the end of a portion of the patron's strands of hair and gripping the end of the strands of hair in the end paper with his hand while he begins coiling it onto a curling device. The primary purposes of the end paper are to increase the grip of the curling device on the strands of hair, to provide cushion between the strands of hair and the surface of the curling device, and to maintain a greater quantity of the permanent wave solution in contact with the strands of hair.

End papers are typically supplied in a package in a stack of small, folded papers which are interleafed and superimposed one upon another. The stack of papers is typically packaged in a carton type container of cardboard or synthetic packaging material. Most commonly the containers of end papers are utilized with the top removed. The cosmetologist must situate the container of end papers within his reach in the work area. Then, to use the end papers, the cosmetologist must reach for each end paper as he applies a curling device to each portion of the patron's strands of hair. To do this, the cosmetologist must select specific strands of hair to be rolled, grasp the strands with one hand, reach for an end paper with the other hand, fold the end paper around the end of the strands of hair, and reach for a curling device with one hand while holding the enfolded strands with the other hand. He then coils the strands of hair onto the curling device, beginning with the ends which are folded in the end paper. This process continues with the cosmetologist segregating another portion of the patron's hair, grasping the end of the strands, reaching for end paper, folding the end paper around the end of the strands of hair, reaching for a curling device and coiling the strands of hair on the curling device until the patron's hair is rolled in the desired manner.

If the container has an opening in the top for removal of the sheets, this process is complicated by the difficulty the cosmetologist has, using only one hand, in grasping and removing one and only one end paper at a time from the container. If the container is full, it is difficult to remove an end paper from the opening without holding the container with one hand and grasping an end paper with the other. Even as the stack is depleted, it remains difficult to remove the sheet one at a time with one hand without causing the container to move or rotate, thereby making it more difficult to retrieve a subsequent sheet. Spillage of the papers is also a problem if the container is utilized with the top removed.

Attempts have been made to provide a slit or other opening in the top of a carton container and have the papers feed one at a time through the slit or opening, depending upon interleafing to cause the successive sheets to feed and depending upon a restriction in the size of the opening to cause the successive sheets to stay in position in the opening for withdrawal one at a time. Removal of the first few sheets from this type of dispenser is often difficult if the carton is packed full. This type of dispenser also works decreasingly well as the stack is substantially depleted. The papers tend not to feed to the opening causing loss of time and productivity for the cosmetologist. This usually necessitates the top of the container being removed for access to the remaining end papers.

A similar problem is experienced with facial tissue dispensers. Means have been employed to elevate the tissue papers as sheets are withdrawn from the top of the stack. The device shown in U.S. Pat. No. 3,942,682 to McKay, utilizes a structure of flexible plastic material consisting of a central platform supported by resiliently displayable legs. This device keeps the top tissue pushed to the top inside surface of the container which enhances successive sheet feed to the opening of the box. While the design theoretically would be applicable to a container of end papers, because the elevating device acts like a spring it has the disadvantage of resulting in substantial pressure of the top of the stack against the top inside surface of the container. This might not create a problem for a container of facial tissues, but this pressure would likely be a real problem for a container of end papers. Because the box would be small and light, the force required to remove the papers from the box would necessitate that the box be held in place with one hand and the paper removed with the other. The papers would also be more likely to tear with the increased force required to extract them from the container. This device would have a further disadvantage of substantially increasing the cost of the end papers.

Attempts have been made to address these problems specifically for end papers. The device shown in U.S. Pat. No. 4,185,753 to Leto provides for a paper container with a slit in the top affixed to a wrist bracelet which is worn on the cosmetologist's arm when he is performing a permanent wave procedure on a patron. As an end paper is withdrawn from the slit in the container, the interleafing results in the next end paper being partially withdrawn through the slit. This device has the same problem as for other sheet feeders in that the initial papers are usually difficult to withdraw and often more than one sheet is removed. As the container empties, the tendency for successive papers not to feed increases. In the Conway patent, U.S. Pat. No. 2,087,181, a dispensing device is clamped to a hair curling device and a spring facilitates the feeding of successive sheets of end paper through a discharge slot.

In U.S. Pat. No. 2,347,823 to Goodman a resilient means such as a spring and removable plate is used to press the stack of end papers against the top opening. The end paper's container is attached to the wrist with a strap and buckle.

In U.S. Pat. No. 3,826,407 to Keating, another variation of a dispenser which is attached to the wrist is described. This device is a complicated one utilizing interconnecting upwardly and sidewardly extended arms and flanges. This device is large, cumbersome and complicated in design.

The devices of Conway and Goodwin require a spring means to force available sheets toward the discharge slot or opening. Further, in the Conway device, the sheets must be loaded in the dispenser at the end opposite the discharge slot. A further problem with the Conway device is that it would be subject to wear and corrosion after repeated use since the permanent wave solution is highly corrosive.

Both the Keating and Goodwin devices are cumbersome and complicated. The Goodwin device has large irregular shaped container, a plurality of fingers in a curved base while the Keating device has a complex arrangement of interconnecting upwardly and sidewardly extending arms and flanges.

All of these devices are difficult to load with the end papers and do not adequately address the problem of dispensing only one sheet of material at a time. While the Goodwin device attempts to address the problem with easy access, this device does not provide for adequate means for elevating the stack of end papers as the papers are withdrawn from the top.

The present invention is an elevating dispenser for cosmetology end papers and other forms of flexible sheet material. The present invention's primary functional advantage over prior devices is that it provides for elevating the stack of sheet material and for retention of the ends of successive sheets in the opening in the top of the container without forcing the top of the stack of sheets against the inside of the top of the container. It employs no springs or other resilient means for elevating the stack of sheets to the opening. The device is simple in design and construction and very inexpensive to make. It can readily be deployed in disposable form.

One objective of the present invention is to provide an elevating dispenser for end paper and other sheet materials which will afford the reliable feed and release of sheets one at a time.

Another objective of the present invention is to provide an elevating dispenser which does not urge the stack of sheets against the inside top of the dispenser and thereby increase the difficulty of removing the sheets from the dispenser.

A further objective of the present invention is to provide an elevating dispenser which does not depend on springs or resilient means for elevating the stack of sheets.

A still further objective is to provide an elevating dispenser which grips successive sheets in the dispensing aperture, thereby avoiding retraction of the sheets into the container.

A still further objective of the present invention is to provide an elevating dispenser which requires the use of one hand only to dispense the sheets one at a time.

A still further objective of this invention is to provide an elevating dispenser of simple design and construction which is inexpensive and will permit the sheets to be packaged and shipped in a disposable dispenser, thereby eliminating the need for separate shipping and dispensing containers and eliminating the need for installing the papers in a dispenser before use.

A still further objective of the invention is to provide an elevating dispenser which can be of unitary construction.

SUMMARY OF THE INVENTION

The present invention provides an elevating dispenser for cosmetology end papers and other interleafed flexible sheet material, which device preferably comprises a carton constructed of thin, stiff cardboard or plastic enclosing a stack of interleafed cosmetology end papers. The top of the carton has an opening for the withdrawal of the end papers one at a time and the opening has flaps which grip the front end of a successive sheet as the proceeding sheet is withdrawn. The bottom is an elevating platform which is flexibly connected on two opposing sides to the base of the adjacent side walls of the carton by flexibly folded extension panels. Each of the two opposing end walls of the carton has a vertical series of tabs formed by finger tip sized concave downward semicircular slits, centered horizontally and aligned with the slits on the opposite wall.

As sheets are withdrawn, one at a time, and the stack is partially depleted, the elevating platform is pushed up by the user. The platform and thus the partially depleted stack of sheets is retained in a progressively higher position by friction between the edges of the elevating platform and the inside walls of the carton. Also, the tabs are pushed in at progressively higher levels as the platform is elevated above the top the tab slits at each level, thereby providing enhanced support for the platform at the tab levels.

DETAILED DESCRIPTION OF THE PREFERRED EMBODIMENTS

Figure 1:
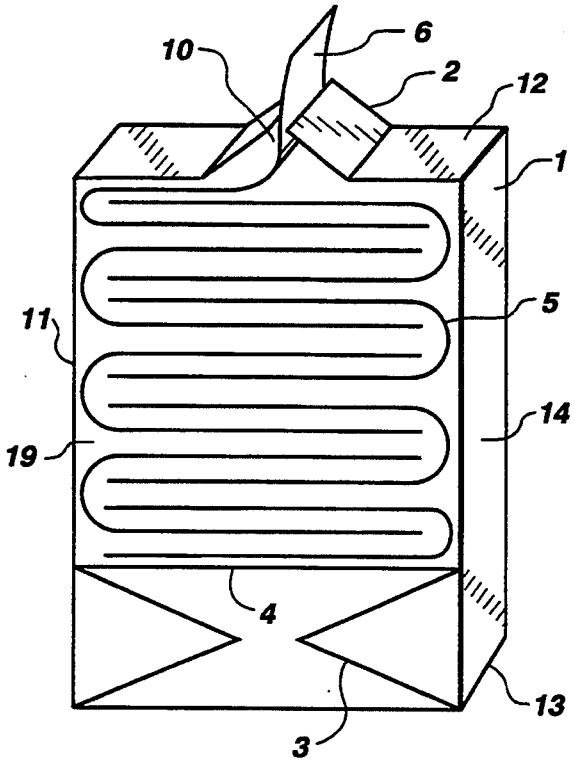
FIG. 1: A perspective end cross section showing interleafed sheets superimposed upon the elevating platform.

Referring first to FIG. 1, there is indicated generally therein at 1, a preferred embodiment of the elevating dispenser in accordance with this invention. The device 1 comprises a carton 11 having a dispensing aperture 10 in the top wall 12 with flaps 2, and an upwardly extendable elevating platform 4 at the bottom of the chamber 19 of the carton upon which the stack 5 of a plurality of interleafed flexible sheets rests and is urged upwards, the elevating platform 4 being flexibly connected on two opposing sides to flexibly folded extension panels 3 which are each flexibly connected to an adjacent base 13 of opposing side walls 14. As an interleafed sheet 6 is withdrawn through the dispensing aperture 10, a subsequent sheet 6 is retained in the aperture, by the flaps 2.

Figure 2:
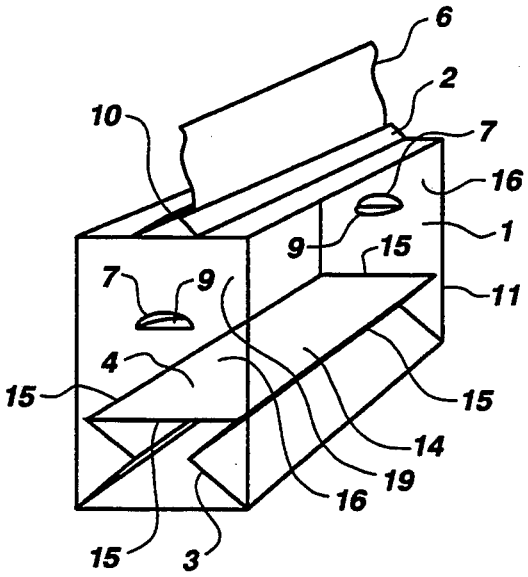
FIG. 2: An end perspective showing the elevating platform and the tabs.

Referring to FIG. 2, as the stack of sheets is depleted by withdrawal of the sheets, the elevating platform 4 is urged upward from time to time through the application of pressure by the user with his thumb or finger on the bottom of the device. After being urged upwards, the elevating platform 4 remains in an elevated position due to friction between the edges 15 of the elevating platform 4 and the inside surface of the carton side walls 14 and the carton end walls 16. Each end wall 16 also has one or more tabs 9, which are formed by slits 7 in the end walls 16, which tabs may be pushed and rotated into the chamber 19 of the carton 11 by the user when the elevating platform 4 has been urged above the top of the slits 7. Each tab 9 on each end wall is aligned vertically and horizontally with a matching tab on the opposite end wall and each such pair of tabs is preferably centered horizontally in the end walls. Under preferred embodiments of the invention, aligned pairs of tabs may be located at one or more levels above the bottom of the carton end walls 16. When the tabs are rotated into the chamber of the carton below the elevating platform, they provide enhanced support for the elevating platform in addition to the frictional support between the edges of the elevating platform and the interior surfaces of the walls of the carton.

Figure 3:
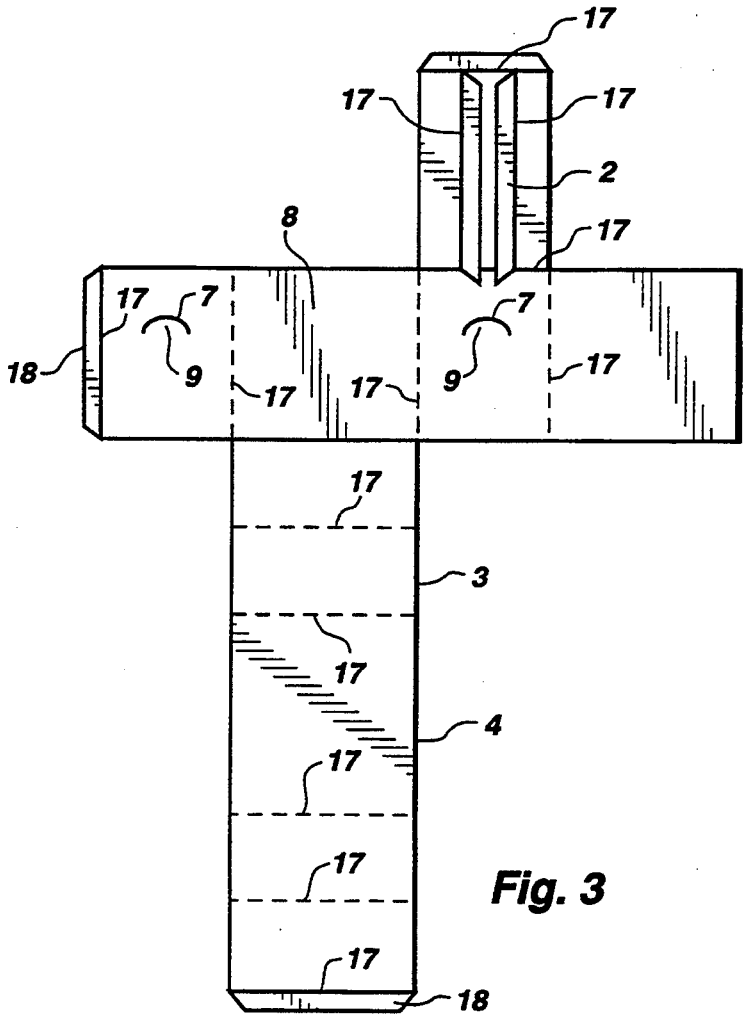
FIG. 3: A plan view of an unassembled elevating dispenser showing unitary construction.
Figure 4:
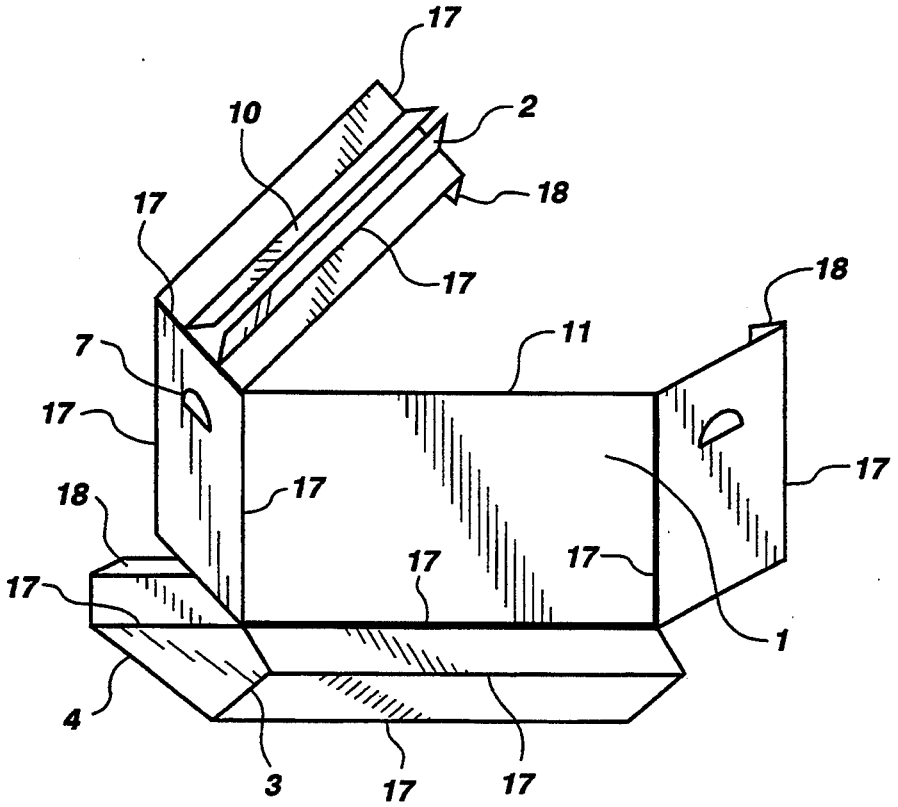
FIG. 4: A perspective view showing a partially assembled elevating dispenser of unitary construction.
Figure 5:
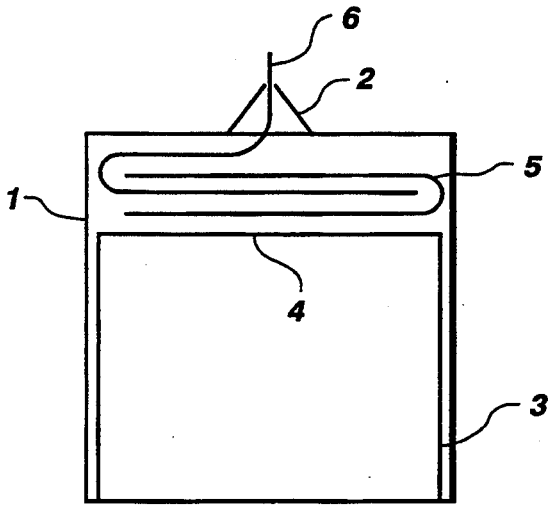
FIG. 5: A vertical cross section view showing a mostly depleted stack of sheets superimposed upon the elevating platform in its fully extended position.

Under the preferred embodiments of the device, the carton is constructed of thin cardboard or plastic, to provide an economical device which may also be of unitary construction 8 as shown in FIG. 3. However, it may be constructed of a variety of thin, stiff materials. If the material used for the carton will not permit flexible bending of the carton material along the fold lines 17, for assembly of the carton 11 as shown in FIG. 4 and for use of the device as described above and as shown in FIG. 1 and FIG. 2, then other means of mechanical flexibility, such as hinges, must be provided for those embodiments of the invention. The device may be also be equipped with a perforated tear out cover for the dispensing aperture, without or without flaps. Other embodiments may provide that the dispensing aperture and flaps be opened by the user by pressing along perforations in the top wall.

Preferred embodiments of the invention incorporate a series of one or more tabs in each end wall, which tabs are aligned vertically and horizontally on the respective end walls, to provide enhanced support for the elevating platform at various levels as it is urged upward with the withdrawal of the interleafed sheets. Other embodiments of the invention may be constructed without tabs and instead rely entirely on friction between the edges of the elevating platform and the inside surfaces of the walls of the carton. Also, while preferred embodiments incorporate aligned matching tabs in the end walls which tabs are also centered horizontally, other embodiments may incorporate tabs in one end wall only, tabs which are not centered horizontally, or tabs which are not matched and aligned with tabs on the opposite end wall.

Under a preferred embodiment of the invention, the tabs 9 are formed by semi-circular, concave downward slits 7 or perforations penetrating the end walls 16 of the carton 11. However, under other embodiments the tabs may be formed by slits or perforations of any partial geometric shape which facilitates, punching, cutting or sawing of the slits or perforations. Under preferred embodiments of the invention, the tabs are flexibly connected to the end walls on the bottom of the tabs, but through the use of certain geometric shapes for the tabs, such as a square or rectangular shape, the tabs may be flexibly connected to the end walls on the side of the tab.

Under a preferred embodiment of the invention, all edges of the elevating platform bear against the adjacent surfaces of the inside of the carton walls. However, other embodiments may provide for the elevating platform to bear only against the opposing end walls or the opposing sidewalls.

Other embodiments of the invention may provide, through the stiffness of the material used to construct the carton, or through mechanical means, in the lines of flexibility 17 at the edge of the elevating platform or in the extension panels, for resistance to the downward movement of the elevating platform as it is urged upwards.

Under a preferred embodiment of the invention, the carton 11 is a unitary construction as shown in FIG. 3 to provide the benefit of economical construction of the carton through such mechanized means as punching, cutting or sawing, and gluing, welding or mechanical fixation. Construction tabs 18 may assist in assembling the carton.

Under a preferred embodiment of the invention, the carton 11 is disposable and the stack of sheets 5 is packaged in the carton. The disposable carton may also be constructed of biodegradable or recyclable material.

Other embodiments of the invention provide for a reusable carton wherein the carton can be refilled. Refilling means will be obvious to a person skilled in the art.

Under a preferred embodiment, the dispensing aperture has two flaps. Other embodiments may provide for only one flap or may provide for a narrow dispensing aperture with no flaps to grip successive sheets.

Other embodiments of the invention and other variations and modifications of the embodiments described above will be obvious to a person skilled in the art. Therefore, the foregoing description is intended to be merely illustrative of the invention and the invention is limited only by the following claims.

What is claimed is:

1. An elevating dispenser for a stack of a plurality of interleafed, flexible sheet materials comprising a carton having a top wall with a dispensing aperture therein, opposing vertical sidewalls, and opposing vertical end walls and said carton having an upwardly extendable elevating platform in the chamber of the carton at the bottom upon which the stack of sheet materials rests, said elevating platform being flexibly attached on each of two opposing sides to the base of the opposing side walls of the carton by one of two flexibly folded extension panels, said extension panels being flexibly folded beneath the elevating platform, and said elevating platform being unattached to the opposing end walls of the carton.

2. The device described in claim 1 wherein at least two opposing edges of the elevating platform bear against the inside surfaces of the vertical walls of the carton.

3. The device described in claim 1 wherein the length and width of the elevating platform are equal to the corresponding dimensions of the inside of the carton.

4. The device described in claim 1 wherein at least one of the two end walls has at least one tab.

5. The device described in claim 1 wherein each end wall has at least one tab which is formed in each end wall by concave downward slits in the end walls.

6. The device described in claim 1 wherein the carton is of unitary construction.

7. The device described in claim 1 wherein at least one of the sides of the dispensing aperture has a flexibly attached flap.

8. The device described in claim 1 wherein each side of the dispensing aperture has a flexibly attached flap.

9. The device described in claim 1 wherein the carton is disposable.

10. A dispensing package for interleafed, flexible sheet materials comprising:

a) a stack of a plurality of interleafed sheets of flexible material;

b) a carton containing the stack of interleafed sheets, said carton having a top wall with a dispensing aperture therein opposing vertical sidewalls, and opposing vertical end walls and said carton having an upwardly extendable elevating platform in the chamber of the carton at the bottom upon which the stack of sheets rests, said elevating platform being flexibly attached on each of two opposing sides to the base of the opposing side walls of the carton by one of two flexibly folded extension panels, said extension panels being folded beneath the elevating platform, and said elevating platform being unattached to the two opposing end walls of the carton.

11. The device described in claim 10 wherein at least two opposing edges of the elevating platform bear against the inside of the vertical walls of the carton.

12. The device described in claim 10 wherein the length and width of the elevating platform are equal to the corresponding dimensions of the inside of the carton.

13. The device described in claim 10 wherein at least one of the two end walls has at least on tab.

14. The device described in claim 10 wherein each end wall has at least one tab which is formed in each end wall by concave downward slits in the end walls.

15. The device described in claim 10 wherein the carton is of unitary construction.

16. The device described in claim 10 wherein at least one of the sides of the dispensing aperture has a flexibly attached flap.

17. The device described in claim 10 wherein each side of the dispensing aperture has a flexibly attached flap.

18. The device described in claim 10 wherein the carton is disposable.

19. An elevating dispenser for a stack of a plurality of interleafed, flexible sheet materials comprising a carton having a top wall with a dispensing aperture therein, opposing vertical sidewalls, and opposing vertical end walls; at least one of the sides of said dispensing aperture having a flexibly attached flap, and said carton having an upwardly extendable elevating platform in the chamber of the carton at the bottom upon which the stack of sheet materials rests, said elevating platform being flexibly attached on each of two opposing sides to the base of the opposing side walls of the carton by one of two flexibly folded extension panels, said extension panels being flexibly folded beneath the elevating platform, said elevating platform being unattached to the opposing end walls of the carton, said end walls having at least one tab which tabs are formed in the end walls by concave downward slits in the end walls, and at least two opposing edges of the elevating platform bearing against the inside surfaces of the vertical walls of the carton.

20. The device described in claim 19 wherein the carton is of unitary construction.

21. The device described in claim 19, wherein the carton is disposable.

* * * * *